US006453841B1

(12) United States Patent
Shearer et al.

(10) Patent No.: US 6,453,841 B1
(45) Date of Patent: Sep. 24, 2002

(54) WINDSHIELD BOTTOM TRIM

(75) Inventors: Robert R. Shearer, Ellenton, FL (US); Michael W. Vadney, Auburn, IN (US)

(73) Assignee: Nelson A. Taylor Co., Inc., Gloversville, NY (US)

( * ) Notice: Subject to any disclaimer, the term of this patent is extended or adjusted under 35 U.S.C. 154(b) by 0 days.

(21) Appl. No.: 09/740,788

(22) Filed: Dec. 21, 2000

(51) Int. Cl.[7] ..... B63B 17/00
(52) U.S. Cl. ..... 114/361
(58) Field of Search ..... 114/361, 343

(56) References Cited

U.S. PATENT DOCUMENTS 2,937,652 A 5/1960 Zimmer, Jr. et al.
2,961,725 A 11/1960 McGee
3,978,535 A * 9/1976 Swan et al. ..... 114/361
4,815,410 A 3/1989 Muhlberger
5,189,980 A 3/1993 Zirkelbach et al.
5,215,032 A 6/1993 Ellis et al.
5,367,977 A 11/1994 Ellis et al.
5,839,388 A 11/1998 Vadney
6,026,761 A 2/2000 Parniske et al.

* cited by examiner

*Primary Examiner*—Stephen Avila
(74) *Attorney, Agent, or Firm*—Nixon & Vanderhye P.C.

(57) ABSTRACT

A boat cover assembly utilizes a windshield bottom trim element which mounts a boat windshield to also mount a boat cover or canopy. The windshield bottom trim element comprises an upper portion defining a windshield receiving channel, a bottom portion having a generally convex outer lower surface, a substantially hollow interior, and a side access opening, and a middle portion comprising a fastener-receiving side opening. A number of different types of fasteners may be received within the fastener-receiving side opening, each connected, or connectable, to a fabric (such as canvas) which can cover the windshield, and also serve as a boat top. The fastener may have a substantially flat first face, a second face having a stem, and first and second flexible projections extending outwardly from the stem, and fabric substantially permanently attached to the elongated body by stitching. The flexible projections may be received by undercut recesses at the access to the fastener-receiving side opening.

26 Claims, 4 Drawing Sheets

WINDSHIELD BOTTOM TRIM

BACKGROUND AND SUMMARY OF THE INVENTION

Many boat owners wish to provide a cover or canopy for the cockpit of their boats, behind the boat's windshield, especially when the boat is not in use, to protect the cockpit area from the elements. This is typically done by mounting a boat cover to the top trim of the windshield and to portions of the boat defining the cockpit behind the windshield, such as shown in U.S. Pat. No. 5,189,980 (the disclosure of which is hereby incorporated by reference herein), or by providing a canopy which includes a mounting channel in the boat deck adjacent the windshield, with the canopy covering the windshield and the cockpit area, such as disclosed in U.S. Pat. No. 6,026,761 (the disclosure of which is hereby incorporated by reference herein).

While conventional boat cover assemblies, such as described above, are very useful, they oftentimes require specialty or additional components in order to provide a complete canopy function, and have little or no versatility as far as accommodating different types of fasteners for different types of boat covers.

According to the present invention a boat cover assembly is provided which utilizes a specially designed bottom trim element of a windshield to effectively mount a boat cover/canopy, and which is versatile, accommodating a wide variety of different types of fastener elements associated with the boat cover/canopy. The invention also relates to the bottom trim assembly associated with the boat, and the bottom trim element per se, as well as the method of providing a boat cover on a boat. The bottom trim element according to the present invention preferably is similar to that disclosed in U.S. Pat. No. 4,815,410 (the disclosure of which is hereby incorporated by reference herein) which is specifically adapted for effectively mounting curved windshields, and one of the fastener systems that the bottom trim element can accommodate may be that disclosed in U.S. Pat. No. 5,839,388 (the disclosure of which is hereby incorporated by reference herein).

The invention also comprises a particular boat cover assembly that is advantageous compared to conventional canvas snaps, or canvas clips, the boat cover according to the invention having a snap-less fastener that avoids the bulge formed by conventional canvas snap fasteners or clips. The boat cover assembly according to this aspect of the invention also may reduce the manufacturing time for the canvas (or other fabric forming a boat cover/canopy) on the production floor by eliminating the time consuming operation of inserting female canvas snaps, and the cover according to the invention can be run over the boat windshield thereby reducing the amount of ultraviolet light that reaches the boat interior. The cover assembly according to this aspect of the invention also provides for improved weather resistance since there is little opportunity for leakage at the top (compared to when the cover is mounted to the windshield top trim), provides a clean appearance when the canvas is removed (since there are no clips), and eliminates the galvanic corrosion that is typically caused by the use of canvas clips, screw-in studs, and rivet studs.

According to one aspect of the present invention there is provided a bottom trim assembly for a boat windshield, comprising: A windshield bottom trim element comprising: an upper portion defining a windshield-receiving channel; a bottom portion having a generally convex outer lower surface, a substantially hollow interior, and a side access opening; and a middle portion comprising a fastener-receiving side opening. A boat windshield operatively disposed in the windshield-receiving channel. And at least one fastener received in the middle portion fastener-receiving side opening.

The generally convex outer lower surface may be connected to a boat by a plurality of fixing elements (such as conventional screws) which are accessible from the substantially hollow interior, the screws passing through predetermined openings formed in the bottom trim element for that purpose. Preferably the bottom trim element comprises a metal extrusion having a substantially continuous wall extending through the top, middle, and bottom portions, opposite the middle portion fastener-receiving opening and opposite the bottom portion side access opening, the wall having a thickened portion at the middle portion to minimize distortion. Also, the middle portion/fastener-receiving opening and the extrusion may be dimensioned and configured so as to receive a conventional canvas clip. The canvas clip may be just one of a plurality of different fasteners that may be received by the fastener-receiving side opening of the bottom trim element.

In the assembly of the invention, the side access opening may be defined by screw cover mounting projections, and a screw cover having projection-receiving recesses receiving the mounting projections may be mounted in the side access opening, the screw cover obscuring the substantially hollow interior (and thereby hiding any nicks in the edges caused during installation of the windshield). Such a screw cover is simpler, less expensive, and typically more effective than the conventional trim piece utilized in the extrusion of U.S. Pat. No. 4,815,410.

According to one aspect of the invention the at least one fastener comprises a plurality of snap fasteners, each having a male snap fastener top, and a shaft extending downwardly therefrom, the shaft received by the middle portion fastener-receiving opening and the male snap fastener top extending outwardly from the middle portion fastener-receiving opening. Also according to this aspect the fastener-receiving opening comprising first and second mounting projections at an access to the fastener-receiving opening, and each fastener shaft has depressions corresponding to and cooperating with the projections to mount the shaft in the fastener-receiving opening. Also in this embodiment a piece of fabric having a plurality of female snap fasteners cooperates with the male snap fasteners received by the middle portion fastener-receiving opening, and the fabric may cover the windshield as well as the cockpit, to provide a boat cover/canopy.

According to another aspect of the invention the middle portion fastener-receiving opening has first and second mounting projections having undercut recesses at an access to the fastener-receiving opening; and the assembly further comprises at least one fastener received in the fastener-receiving opening, the fastener comprising an elongated body having a substantially flat first face, and a second face having a stem and first and second flexible projections extending outwardly from the stem, the flexible projections releasably received by the undercut recesses; and the elongated body is operatively attached to a piece of fabric. Preferably the elongated body is substantially permanently attached by stitching (and perhaps also by adhesive or other fastening components) to the fabric, and the fabric extends substantially over, and covering, the windshield. Preferably the fabric also comprises a boat top, covering the cockpit adjacent the windshield.

The fabric may comprise any suitable fabric, but for most situations will be a type of canvas. While a number of different fastener systems have been described above, it is to be understood that preferably the middle portion fastener-receiving opening is dimensioned and configured to receive at least two different types of fasteners, including a plurality of snap fasteners, as described above, and at least one fastener without conventional metal snaps substantially permanently attached by stitching to fabric.

According to another aspect of the present invention a boat windshield bottom trim element per se is provided. The element typically comprises a metal extrusion, and includes: an upper portion defining a windshield-receiving channel. A bottom portion having a generally convex outer lower surface, a substantially hollow interior, and a side access opening. And a middle portion comprising a fastener-receiving side opening which has first and second mounting projections having undercut recesses at an access to the fastener-receiving opening. The side access opening and the fastener-receiving side opening typically comprise channels, especially where the element comprises a metal extrusion.

In one preferred embodiment, the metal extrusion has a substantially continuous wall extending through the top, middle, and bottom portions, opposite the middle portion fastener-receiving opening and opposite the bottom portion side access opening; the wall having a thickened portion at the middle portion to minimize distortion. Also preferably the substantially hollow interior of the bottom portion which corresponds to the convex lower surface has a substantially constant radius, which allows rotation to the desired angle on hole punching tooling (to form screw receiving holes in the extrusion) while not requiring a constant radius of the outside surface; that is the convex lower surface need not have a substantially constant radius, although it may. Also, in this embodiment preferably the side access opening is defined by screw cover mounting projections, and the element further comprises a screw cover having projection-receiving recesses receiving the mounting projections, the screw cover obscuring the substantially hollow interior.

According to another aspect of the present invention a boat cover assembly per se is provided comprising: A bottom trim mounting a boat windshield and including a fastener receiving opening which has first and second mounting projections having undercut recesses at an access to the fastener-receiving opening. At least one fastener received in the fastener-receiving opening, the fastener comprising an elongated body having a substantially flat first face, and a second face having a stem and first and second flexible projections extending outwardly from the stem, the flexible projections releasably received by the undercut recesses. And a piece of fabric operatively attached to the elongated body and extending therefrom to serve as a boat cover. The elongated body may be substantially permanently attached, by stitching (and perhaps other components), to the fabric, and the fabric may extend substantially over, and covering, the windshield. The fabric may also comprise a boat cover, extending over the cockpit area behind the windshield.

According to another aspect of the present invention there is provided a method of providing boat covers on boats comprising: a) Producing a uniform configuration metal extrusion having a fastener-receiving opening capable of receiving at least first and second different types of fasteners. b) Forming the extrusion into at least first and second boat windshield bottom trim elements, and attaching a boat windshield to each of the boat windshield bottom trim elements. c) Attaching the first boat windshield bottom trim element with windshield to a first boat, and attaching a first type of fastener to the first boat trim element, and attaching a fabric to the first type of fastener to serve as a first boat cover. And d) attaching the second boat windshield bottom trim element with windshield to a second boat, and attaching a second type of fastener (different than the first type) to the second boat trim element, and attaching a fabric to the second type of fastener to serve as a second boat cover.

In the method as described above, at least one of (and preferably both of) (c) and (d) are practiced to provide the boat cover over the windshield, and preferably at least one of, and preferably both of, (c) and (d) are practiced so as to provide a boat cover over the cockpit area behind the windshield, providing a boat top or canopy. Also, it is possible to use two different fastener systems on the same boat (using the common windshield bottom trim).

It is the primary object of the present invention to provide a simple yet versatile and effective assembly and method for attaching a boat cover in association with a boat windshield, to provide a boat cover or canopy, as well as to provide advantageous components of the assembly. This and other objects of the invention will become clear from an inspection of the detailed description of the invention and from the appended claims.

DETAILED DESCRIPTION OF THE DRAWINGS

Figure 1:
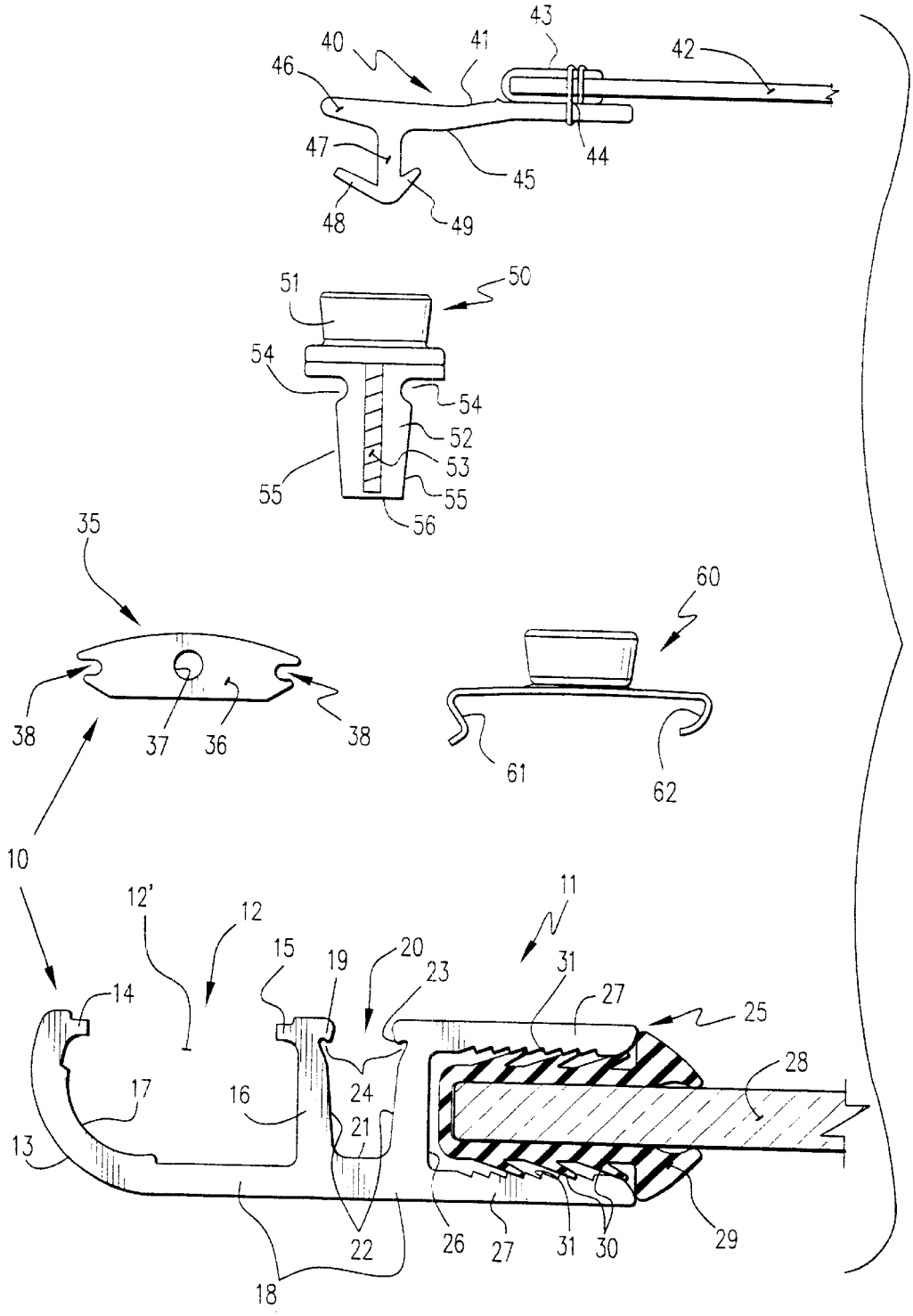
FIG. 1 is a side exploded view, partly in cross section and partly in elevation, of an exemplary boat windshield trim assembly according to the present invention, including three different types of fastener systems that may be associated therewith.

FIG. 1 schematically illustrates a bottom trim assembly 10 for a boat windshield according to the present invention, with various elements shown in exploded view, and showing three different types of fastener systems that may be associated therewith. According to one aspect of the present invention there is provided a boat windshield bottom trim element 11 which, per se, and in the combination of the assembly 10, is unique and particularly advantageous.

The windshield bottom trim element 11 comprises a bottom portion having a side access opening 12 to a substantially hollow interior 12', and a generally convex outer lower surface 13. The windshield bottom trim element 11, preferably comprises a metal (e.g. aluminum) extrusion (the access opening 12 comprising a channel). The bottom portion may be substantially as disclosed in U.S. Pat. No. 4,815,410, and the surface 13 may have holes punched therein which receive fixing elements, such as screws, for attachment thereof to a boat, such as disclosed in the U.S. Pat. No. 4,815,410. The bottom portion preferably has the access opening 12 defined by screw cover-mounting projections 14, 15, and opposite the generally convex outer surface 13 is a wall 16 providing the division between the bottom portion of the windshield bottom trim element 11 and a middle portion thereof (to be hereinafter described).

The substantially hollow interior (12') of the bottom portion corresponding to the convex lower surface 13 has a substantially constant radius portion 17. The substantially constant radius portion 17 allows rotation of the extrusion 11 to the desired angle in hole punching tooling, while not requiring that the generally convex lower surface 13 have a substantially constant radius (although it may).

The extrusion 11 also has a substantially continuous wall 18 extending through the top, middle, and bottom portions of the extrusion 11, opposite the side access opening 12 (and opposite the middle portion fastener-receiving opening as hereinafter described). Preferably the wall 18 has a thickened portion (readily seen in each of FIGS. 1 through 3, such as immediately below reference numeral 21 in FIG. 1) at the middle portion of the extrusion 11 to minimize distortion.

The windshield bottom trim element 11 also has a middle portion, comprising a fastener-receiving side opening 20 (substantially opposite the wall 18) which may have a bottom 21, and an access thereto defined by first and second mounting projections 19, 23 having undercut recesses 24. The side walls 22 may taper downwardly, as illustrated most clearly in FIG. 1, from the undercut recesses 24 to the bottom 21. The side opening 20, with this configuration, is designed to receive a variety of different fastener systems.

The windshield bottom trim element 11 also comprises an upper portion defining a windshield receiving channel 25. The upper portion may be substantially identical to that disclosed in U.S. Pat. No. 4,815,410, having a bottom 26 of the channel, and side walls 27 of the channel 25, the channel 25 being directed substantially perpendicular to the openings 12, 20, and receiving a conventional boat windshield 28 therein. The boat windshield 28 is preferably mounted by the conventional flexible and resilient material mounting element 29, which may have wings 30 cooperating with notches 31 formed in the channel 25. The conventional windshield 28 is typically glass or a type of plastic, and is transparent or at least translucent. The windshield 28 may comprise a curved windshield, or may be a section of substantially flat windshield.

Figure 2:
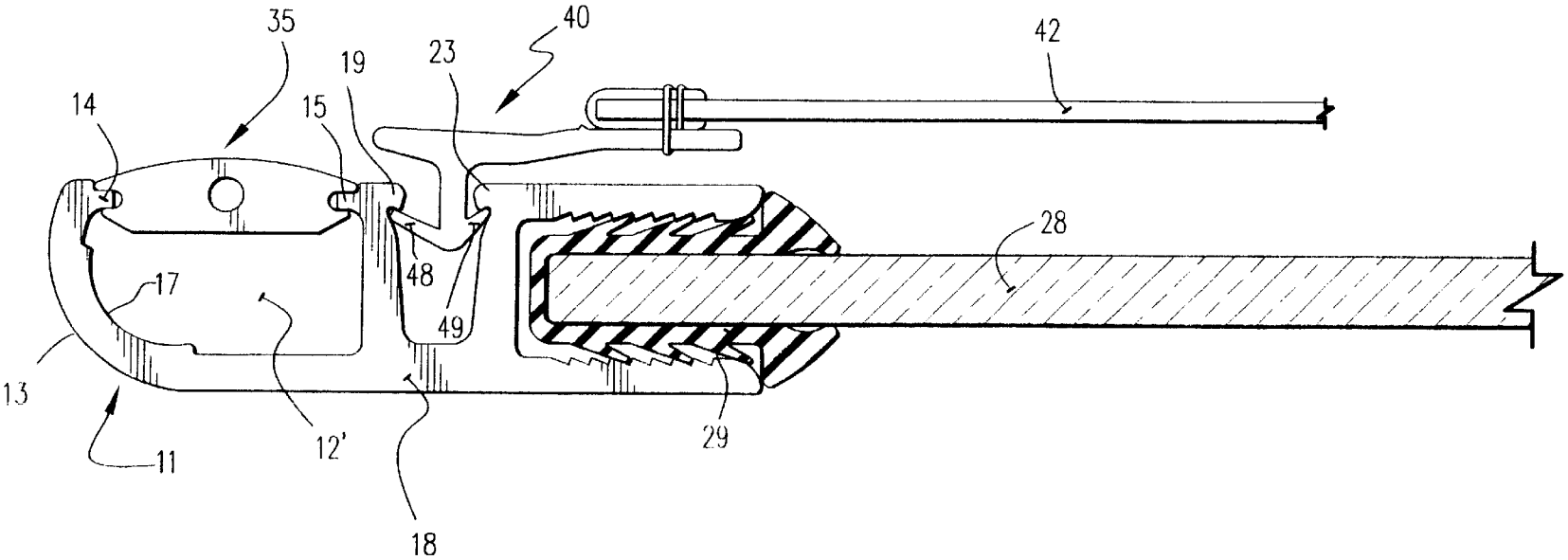
FIG. 2 is a side assembled view, partly in cross section, and partly in elevation, of the assembly of FIG. 1 with the particular snap-less boat cover assembly of FIG. 1 associated therewith.
Figure 3:
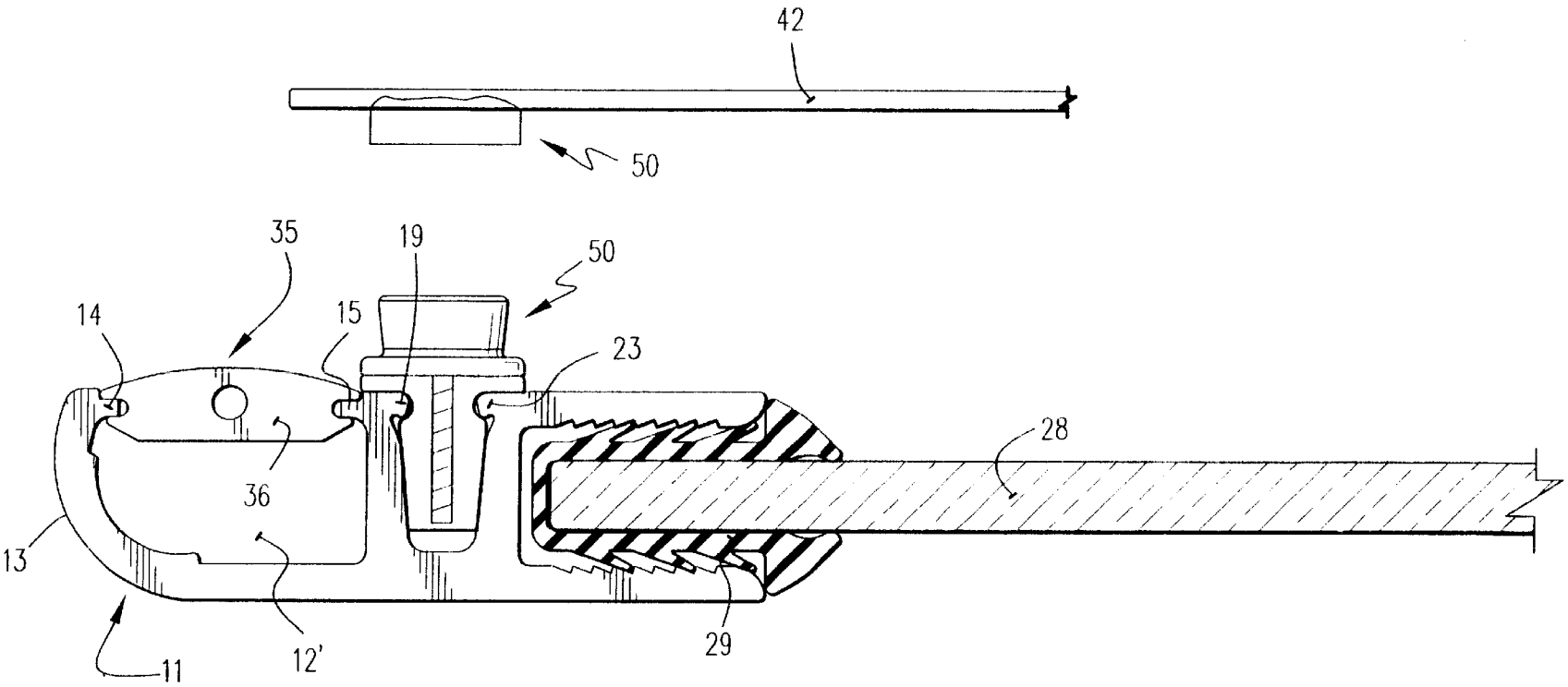
FIG. 3 is a view like that of FIG. 2 only with a snap cover assembly of FIG. 1 associated therewith.

FIG. 1 shows an exemplary screw cover 35 according to the present invention detached from the windshield bottom trim element 11. The screw cover 35 is preferably of plastic, and is decorative (e.g. it may be colored or may be made to look like the element 11), and includes a body 36 that may have a hollow interior portion 37, and has projection receiving recesses 38 at opposite ends thereof. As seen in FIGS. 2 and 3, the recesses 38 preferably receive the projections 14,15 therein so that the screw cover 35 obscures the substantially hollow interior 12' of the bottom portion of the extrusion 11, thereby hiding nicks in the edges of the extrusion bottom portion caused during installation of the windshield bottom trim element 11 on the boat deck, and also covering up the fixing elements (screws) holding the extrusion 11 to the boat.

FIG. 1 also illustrates a particular boat cover with fastener assembly 40 that is desirably used with the extrusion 11, and shown separated from the extrusion 11, while FIG. 2 shows the assembly 40 releasably mounted to the extrusion 11.

The assembly 40 comprises an elongated fastener body 46 which has first and second faces 41, 45. The first face 41 does not have any particular projections that are functional associated therewith, and thereby may be considered substantially flat (which includes contours or bulges). A piece of fabric 42, which may be canvas or any suitable other material for use as a boat cover/canopy, is operatively connected to the elongated body 46. This operative connection may be any suitable means, including adhesives, plastic or metal fasteners, welding, etc. In the preferred embodiment, however, the body 46 is attached to the fabric 42 substantially permanently at least by stitching 44. There may be a wrap 43 at the edge of the fabric 42 to prevent fraying, and the stitching 44 may pass through the wrap 43.

The elongated body 46 has a stem 47 extending outwardly from the second face 45, having first and second flexible projections 48, 49 associated therewith. As seen in FIG. 2, the projections 48, 49 are releasably received by the undercut recesses 24 in the opening 20 and provide a substantially water-tight seal between the fabric 42 and the element 11.

Preferably the opening 20 is a channel, and the elongated body 46 extends the length of the channel, although under some circumstances the body 46 can be segmented, or spaced portions thereof provided along the opening 20. Alternatively, while the body 46 may extend substantially the entire length of the channel/opening 20, stems 47 with projections 48, 49 may be provided at spaced locations therealong.

The elongated body 46 may be made of a wide variety of materials. Preferably the stem 47 is integral with body 46, and the flexible projections 48, 49 are also integral with the stem 47. In this situation the body 46, and the components 47–49 preferably are of plastic, with the projections 48, 49 configured and dimensioned so that they have at least some flexibility, although the flexibility of the projection 48 may be much greater than that of the projection 49. Alternatively, the elements 46–49 may be different materials and attached together by adhesive, welding, or in other manners.

The boat cover assembly 40 has a number of advantages compared to conventional canvas clips. Because the assembly 40 is snap-less (having no conventional metal snaps), it provides a clean appearance when the fabric 42 is removed because there are no snaps extending outwardly from the opening 20, and there are no bulges when the assembly 40 is connected to the extrusion 11, as seen in FIG. 2, again because there are no snaps. Also, the assembly 40 may reduce manufacturing time for the cover on the production floor by eliminating the time consuming operation of inserting female snaps into the fabric 42. Also, the cover 40 when used as illustrated in FIG. 2 may be run over the windshield 28 thereby reducing the amount of ultraviolet light that reaches the boat interior, in addition to desirably extending over the cockpit behind the windshield 28. Also, the assembly 40 has improved weather resistance especially compared to systems where the fabric 42 is attached to the top trim since there is no leaking at the top. Further, especially where the body 46 is plastic, the use of the assembly 40 eliminates galvanic corrosion that is typically caused by the use of canvas clips, screw-in studs, and rivet studs.

The extrusion 11 is versatile, not requiring the use of the assembly 40, but also allowing the use of the fastener system 50 illustrated in exploded view in FIG. 1, and connected to the extrusion 11 in FIG. 3, the fastener system 50 being generally as disclosed in U.S. Pat. No. 5, 839,388. That is, the fastener system 50, when assembled in the element 11, includes a plurality of different fasteners each having a male snap fastener top 51 integral with a screw threaded core 53, and an anchor 52 mounted in the element 11. The anchor 52 also includes recesses 54 adjacent the snap fastener top 51, tapered sides 55 from the recesses 54 (the side 55 substantially corresponding to the surfaces 22), and a substantially flat bottom 56. As seen in FIG. 3, the recesses 54 are received by the mounting projections 19, 23 of the opening 20.

As seen in FIG. 3, the plurality of the fasteners 50 cooperate with conventional female snap fasteners 59 fastened into the fabric (e.g. canvas) cover 42.

FIG. 1 also shows a conventional canvas clip 60 may have a male snap fastener with clip element 61, 62. The extrusion 11 preferably has the opening 20, as well as the channel 25, configured to cooperate with the clip 60, the projection 61 being received by the undercut recess 24 below the projection 19, and the clip portion 62 received in the channel 25 between the wall 27 and the mounting insert 29. The conventional canvas clip 60 receives the female fastener 59 such as seen in FIG. 3 to hold the boat cover/fabric 42 in place, a plurality of clips 60 being provided instead of the snap fastener elements 50.

It will thus be seen that according to the present invention that by making an extrusion 11 having a predetermined uniform configuration, the extrusion 11 can be segmented and provided as bottom trim for a number of different boats, and different fastening systems (such as 40, 50, 60) associated with those different boats, or even with the same boat, without in any way changing the extrusion 11.

Figure 4:
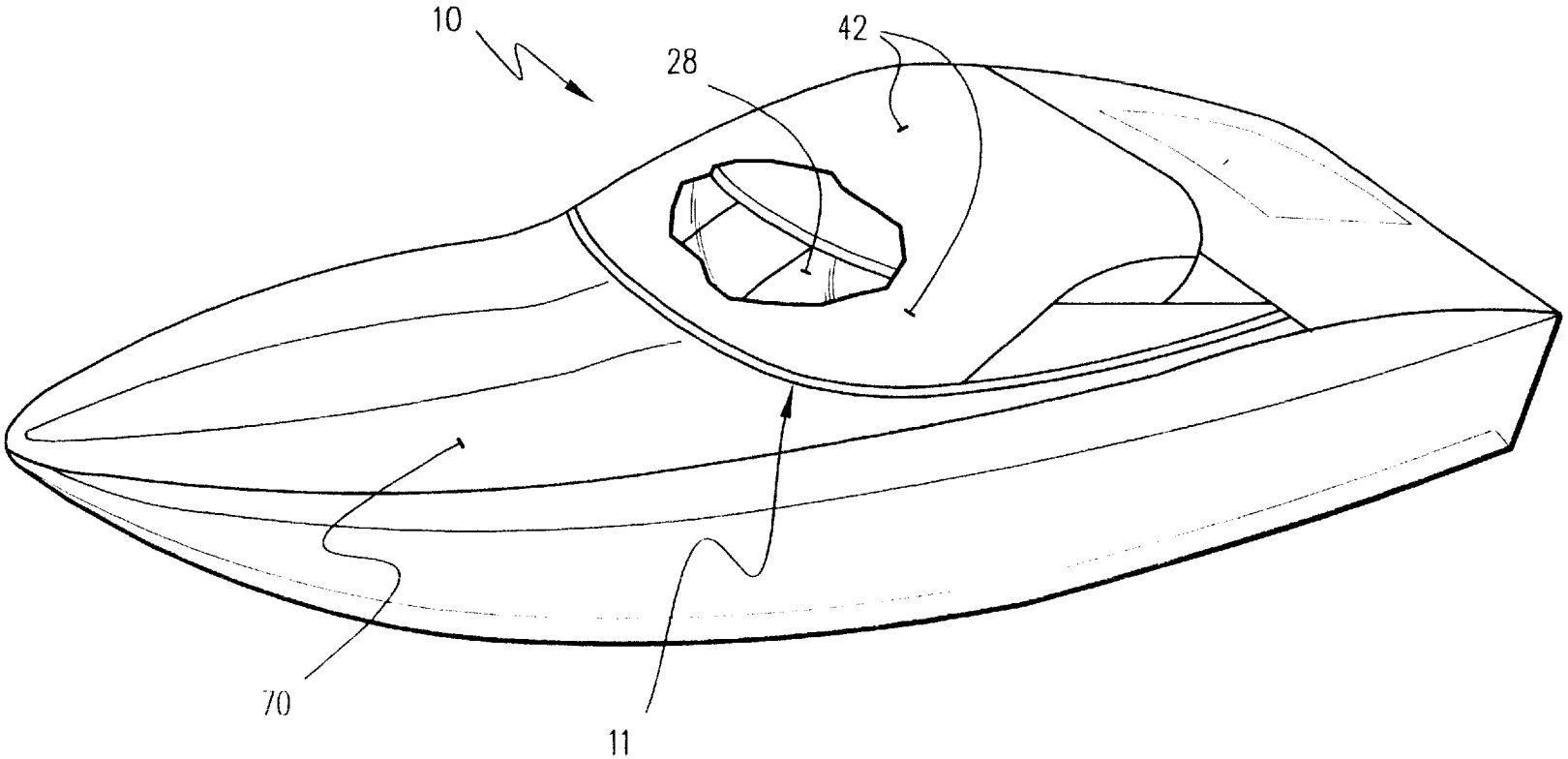
FIG. 4 is a perspective schematic view of the assembly of FIG. 2 mounted in association with an exemplary boat.

FIG. 4 shows a bottom trim assembly 10, including the windshield bottom trim element 11 and the boat cover assembly 40, according to the present invention mounted in association with a conventional boat 70. As seen in FIG. 4, the windshield bottom trim element 11 and windshield 28 associated therewith receive the fabric 42 so that the fabric 42 covers the windshield 28, and also covers the cockpit behind the windshield 28, providing a boat top/canopy. The fabric 42 may be attached to portions of the boat 70 defining the cockpit, aside from the windshield bottom trim element 11, in any conventional manner.

It will thus be seen that according to the present invention a highly advantageous bottom trim assembly for a boat, boat bottom trim element per se, boat cover assembly per se, and a method of providing boat covers on boats, have been provided which are highly advantageous and versatile. While the invention has been herein shown and described in what is presently conceived to be the most practical and preferred embodiment thereof, it will be apparent to those skilled in the art that many modifications may be made thereof within the scope of the invention, which scope is to be accorded the broadest interpretation of the appended claims so as to encompass all equivalent assemblies, elements and methods.

What is claimed is:

1. A bottom trim assembly for a boat windshield, comprising:

a windshield bottom trim element comprising: an upper portion defining a windshield-receiving channel; a bottom portion having a generally convex outer lower surface, a substantially hollow interior extending along a longitudinal direction of the bottom trim element, and a side access opening oriented substantially perpendicular to said substantially hollow interior; and a middle portion comprising a fastener-receiving side opening;

a boat windshield operatively disposed in said windshield-receiving channel; and at least one fastener received in said middle portion fastener-receiving side opening.

2. A bottom trim assembly for a boat windshield, comprising:

a windshield bottom trim element comprising: an upper portion defining a windshield-receiving channel; a bottom portion having a generally convex outer lower surface, a substantially hollow interior, and a side access opening; and a middle portion comprising a fastener-receiving side opening, wherein said generally convex outer lower surface is connected to a boat by a plurality of fixing elements, accessible from said substantially hollow interior;

a boat windshield operatively disposed in said windshield-receiving channel; and at least one fastener received in said middle portion fastener-receiving side opening.

3. An assembly as recited in claim 2 wherein said side access opening is defined by screw cover mounting projections; and further comprising a screw cover having projection-receiving recesses receiving said mounting projections, said screw cover obscuring said substantially hollow interior.

4. An assembly as recited in claim 2 wherein said at least one fastener further comprises a plurality of snap fasteners, each having a male snap fastener top, and a shaft extending downwardly therefrom, said shaft received by said middle portion fastener-receiving opening and said male snap fastener top extending outwardly from said middle portion fastener-receiving opening.

5. An assembly as recited in claim 4 wherein said fastener-receiving opening comprises first and second mounting projections at an access to said fastener-receiving opening, and wherein each fastener shaft has depressions corresponding to and cooperating with said projections to mount said shaft in said fastener-receiving opening.

6. An assembly as recited in claim 4 further comprising a piece of fabric having a plurality of female snap fasteners cooperating with said male snap fasteners received by said middle portion fastener-receiving opening.

7. An assembly as recited in claim 1 wherein said bottom trim element comprises a metal extrusion having a substantially continuous wall extending through said top, middle, and bottom portions, opposite said middle portion fastener-receiving opening and opposite said bottom portion side access opening, said wall having a thickened portion at said middle portion to minimize distortion.

8. An assembly as recited in claim 2 wherein said middle portion fastener-receiving opening has first and second mounting projections having undercut recesses at an access to said fastener-receiving opening; and further comprising at least one fastener received in said fastener-receiving opening, said fastener comprising an elongated body having a substantially flat first face, and a second face having a stem and first and second flexible projections extending outwardly from said stem, said flexible projections releasably received by said undercut recesses; and said elongated body operatively attached to a piece of fabric.

9. An assembly as recited in claim 8 wherein said elongated body is substantially permanently attached by stitching to said fabric, and wherein said fabric extends substantially over, and covering, said windshield.

10. An assembly as recited in claim 9 wherein said fabric also comprises a boat top.

11. An assembly as recited in claim 7 wherein said middle portion fastener-receiving opening and said extrusion are dimensioned and configured to receive a conventional canvas clip.

12. An assembly as recited in claim 2 wherein said middle portion fastener-receiving opening is dimensioned and configured to receive at least two different types of fasteners, including a plurality of snap fasteners, and at least one fastener substantially permanently attached by stitching to fabric.

13. An assembly as recited in claim 1 wherein said middle portion fastener-receiving opening has first and second mounting projections having undercut recesses at an access to said fastener-receiving opening.

14. An assembly as recited in claim 13 further comprising at least one fastener received in said fastener-receiving opening, said fastener comprising an elongated body having a substantially flat first face, and a second face having a stem and first and second flexible projections extending outwardly from said stem, said flexible projections releasably received by said undercut recesses; and said elongated body operatively attached to a piece of fabric.

15. A boat windshield bottom trim element comprising:

an upper portion defining a windshield-receiving channel;

a bottom portion having a generally convex outer lower surface, a substantially hollow interior extending along a longitudinal direction of the bottom trim element, and a side access opening oriented substantially perpendicular to said substantially hollow interior; and a middle portion comprising a fastener-receiving side opening which has first and second mounting projections having undercut recesses at an access to said fastener-receiving opening.

16. A boat windshield bottom trim element comprising:

an upper portion defining a windshield-receiving channel;

a bottom portion having a generally convex outer lower surface, a substantially hollow interior, and a side access opening; and a middle portion comprising a fastener-receiving side opening which has first and second mounting projections having undercut recesses at an access to said fastener-receiving opening, wherein said element comprises a metal extrusion, and wherein said side access opening and said fastener-receiving side opening comprise channels.

17. An element as recited in claim 16 wherein said metal extrusion has a substantially continuous wall extending through said top, middle, and bottom portions, opposite said middle portion fastener-receiving opening and opposite said bottom portion side access opening, said wall having a thickened portion at said middle portion to minimize distortion.

18. An element as recited in claim 16 wherein said substantially hollow interior of said bottom portion corresponding to said generally convex lower surface has a substantially constant radius portion.

19. An element as recited in claim 18 wherein said generally convex lower surface does not have a substantially constant radius.

20. An element as recited in claim 15 wherein said side access opening is defined by screw cover mounting projections; and further comprising a screw cover having projection-receiving recesses receiving said mounting projections, said screw cover obscuring said substantially hollow interior.

21. A boat cover assembly comprising:

a windshield bottom trim mounting a boat windshield and including a fastener receiving opening which has first and second mounting projections having undercut recesses at an access to said fastener-receiving opening, the windshield bottom trim also including a bottom portion connected to a boat by a plurality of fixing elements extending into said bottom portion;

at least one fastener received in said fastener-receiving opening, said fastener comprising an elongated body having a substantially flat first face, and a second face having a stem and first and second flexible projections extending outwardly from said stem, said flexible projections releasably received by said undercut recesses; and a piece of fabric operatively attached to said elongated body and extending therefrom to serve as a boat cover.

22. An assembly as recited in claim 21 wherein said elongated body is substantially permanently attached by at least stitching to said fabric, and wherein said fabric extends substantially over, and covering, said windshield.

23. An assembly as recited in claim 22 wherein said fabric also comprises a boat top.

24. A method of providing boat covers on boats comprising:

a) producing a uniform configuration metal extrusion having a fastener-receiving opening capable of receiving at least first and second different types of fasteners;

b) forming the extrusion into at least first and second boat windshield bottom trim elements, and attaching a boat windshield to each of the boat windshield bottom trim elements;

c) attaching the first boat windshield bottom trim element with windshield to a first boat, and attaching a first type of fastener to the first boat windshield bottom trim element, and attaching a fabric to the first type of fastener to serve as a first boat cover; and d) attaching the second boat windshield bottom trim element with windshield to a second boat, and attaching a second type of fastener, different than the first type, to the second boat windshield bottom trim element, and attaching a fabric to the second type of fastener to serve as a second boat cover.

25. A method as recited in claim 24 wherein at least one of c) and d) are practiced to provide the boat cover over the windshield.

26. A method as recited in claim 24 further comprising attaching a second type of fastener to the first boat windshield bottom trim element in addition to the first type of fastener.

* * * * *